US005604944A

United States Patent [19]

Meade

[11] Patent Number: 5,604,944

[45] Date of Patent: Feb. 25, 1997

[54] REINFORCED ARM PROTECTOR HEAD REST

[76] Inventor: Robert Meade, 14262 Ida Way, Westminster, Calif. 92683

[21] Appl. No.: 541,957

[22] Filed: Oct. 10, 1995

[51] Int. Cl.[6] ..... A47G 9/00

[52] U.S. Cl. ..... 5/643; 5/636; 5/646

[58] Field of Search ..... 5/636, 638, 639, 5/643, 646, 630, 632; D6/601

[56] References Cited

U.S. PATENT DOCUMENTS

D. 198,449 6/1964 Kerr ..... D6/601
324,785 8/1885 Pitney ..... 5/643
2,910,707 11/1959 Lawser et al. ..... 5/636
3,883,906 5/1975 Sumpter ..... 5/632

*Primary Examiner*—Alexander Grosz
*Attorney, Agent, or Firm*—Dennis W. Beech

[57] ABSTRACT

The arm protector head rest is a half cylindrical shaped head rest with an outer and inner surface having a soft foam wall body. The head rest has support ridges of integral skin polyurethane foam on the inner surface sufficient to support the weight of a person's head when resting. A passageway exists between the inner surface and the bed such that a person may place their arms under the head rest and thereby under the resting head without the weight of the head on the arms. An alternate head rest uses U-shaped ribs in the wall to provide the structural support for the weight of the head.

2 Claims, 3 Drawing Sheets

REINFORCED ARM PROTECTOR HEAD REST

BACKGROUND OF THE INVENTION

1. Field of the Invention

This invention relates to devices on which to rest a person's head, such as, pillows, head rests, etc. More specifically the device relates to head rests which protect a person's arm when placed under the head rest. The new device provides a head rest with a tunnel-like opening for receiving a person's arm.

2. Description of Related Art

There are currently in use various devices on which a person may rest their head when sleeping, lying back in a chair or otherwise relaxing the neck. The most common of these is the traditional pillow.

Variations of the standard pillow exist such as U.S. Pat. No. 3,883,906 which is intended to prevent a sleeper's arms from engagement with the head in a manner which could result in the cutting off of circulation in the arms. However, designs such as this prevent the user from placing their arms under their head rather than providing a means to protect an arm when placed under the head of the sleeper.

The present invention provides a simple means to allow a person's arm to be placed under the head rest whether or not a pillow is used. The arm protector head rest may be placed under a traditional pillow and used to protect the person's arm from loss of circulation. The head rest may also be used alone wherein the users head rests directly on the head rest with an arm placed underneath.

SUMMARY OF THE INVENTION

A primary objective of the present invention is to provide a head rest on which a person may rest their head, which head rest provides for placing an arm under the head rest and head in a manner that does not require the arm to support the weight of the head. Another object of the invention is to allow the head rest to be used under a pillow on which a person is sleeping.

In accordance with the description presented herein, other objectives of this invention will become apparent when the description and drawings are reviewed.

DESCRIPTION OF THE PREFERRED EMBODIMENT

The arm protector head rest consists of a half cylinder shaped support structure which when placed on a surface such as a bed forms a raised support on which to rest a persons head and a tunnel or passageway for insertion of an arm. The passageway allows a person to place their arm under the users head without having the weight of the head resting on the arm. While the cross-sectional shape of the head rest is generally semicircular other oblong shapes may be used.

Figure 1:
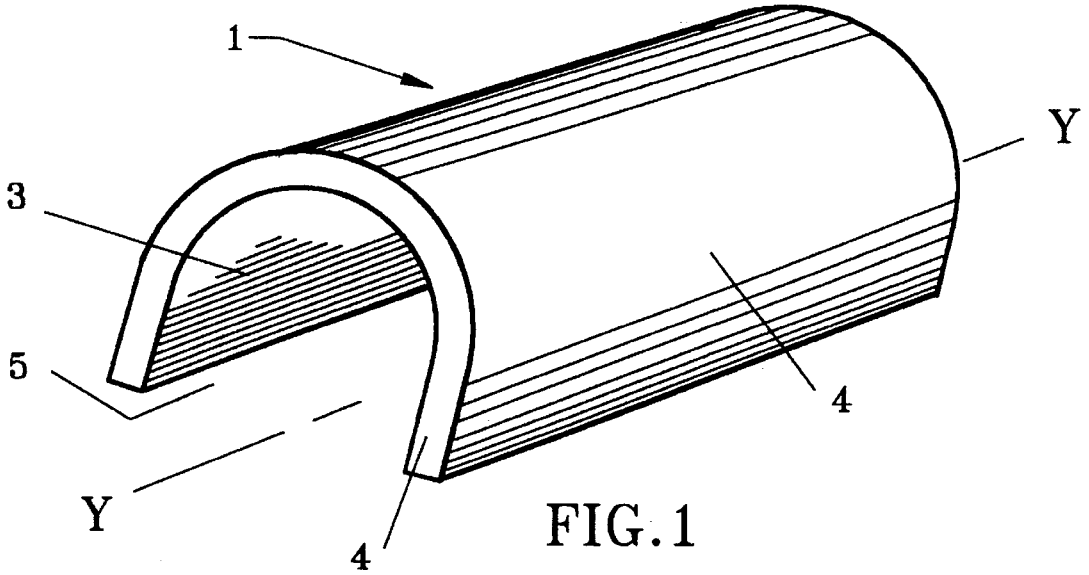
FIG. 1 illustrates a perspective view of the arm protector head rest.
Figure 6:
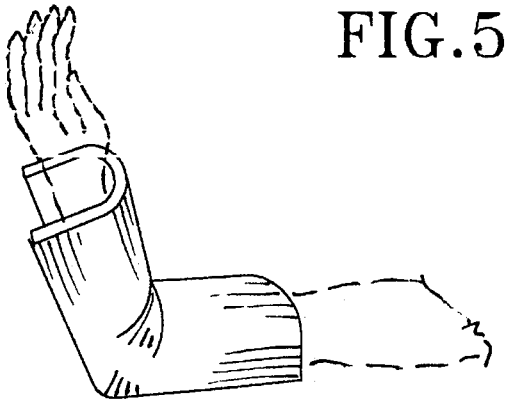
FIG. 6 illustrates the head rest bent in a curved shape with the arm.
Figure 13:
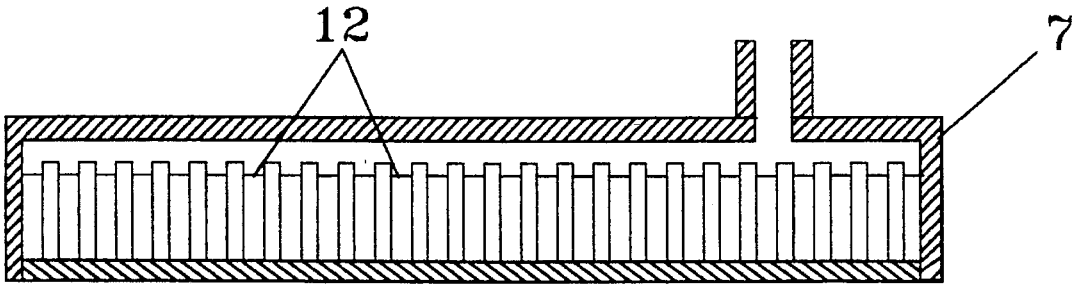
FIG. 13 illustrates a cross-sectional view of the injection mold.
Figure 14:
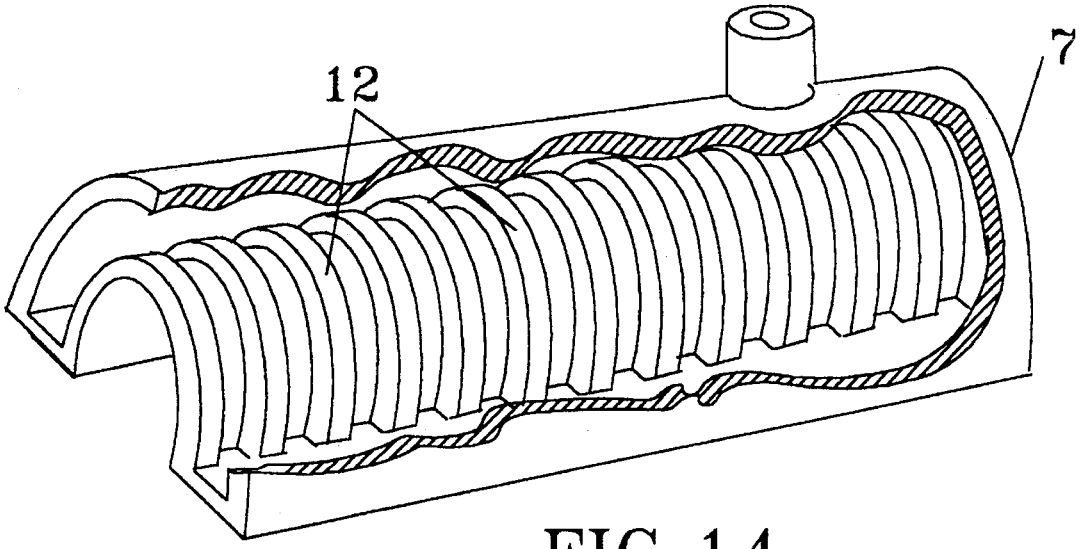
FIG. 14 illustrates a perspective cut away view of the injection mold.
Figure 9:
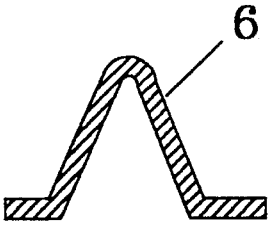
FIG. 9 illustrates a rounded triangular ridge.
Figure 8:
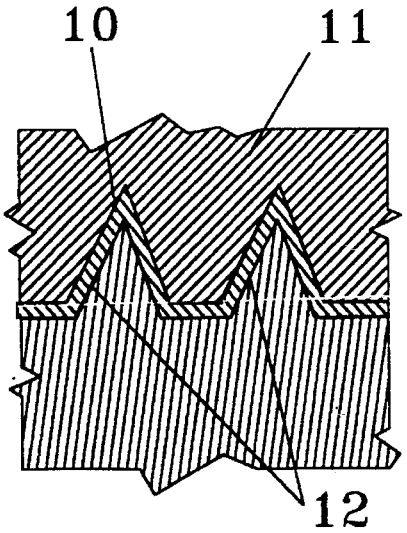
FIG. 8 illustrates a cross-section of the injection mold and soft/rigid polyurethane foam interface.
Figure 10:
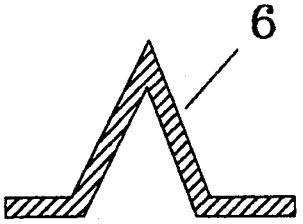
FIG. 10 illustrates a pointed triangular ridge.

Referring to FIGS. 1 through 6, the arm protector head rest (1) is generally half cylindrical in shape having an outer surface (2) and inner surface (3). The thickness of the wall (4) between the outer surface (2) and inner surface (3) varies with the material and structure of the head rest (1). The use of the head rest (1) for support of a person's head and protection of the arm while the neck is relaxed is shown in FIGS. 2 through 6. The preferred embodiment is to form the head rest (1) such that it is flexible along the longitudinal dimension Y—Y, as illustrated in FIG. 1. As illustrated in FIG. 6, this allows bending of the arm while providing structural support for the weight of the person's head.

For use in the normal head rest and sleeping configuration, a head rest (1) of from 10 inches to 17 inches in length with a height of 3 inches to 5 inches has been found suitable. The general radius of the base of the passageway (5) can vary from 4 inches to 9 inches.

Figure 11:
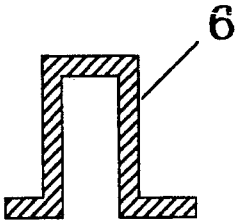
FIG. 11 illustrates a long rectangular ridge.
Figure 12:
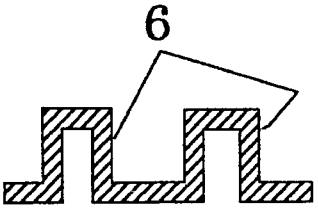
FIG. 12 illustrates a short rectangular ridge.

Referring to FIG. 8 through 14, an arm protector head rest constructed of integral skin polyurethane foam is illustrated. In this embodiment, the head rest (1) is formed with a series of ribs or ridges (6) on the inner surface (3) to provide the structural support for the weight of a person's head. As illustrated in FIGS. 9 through 12 these ridges (6) may be of various shapes depending on the intended use. It has been found for the head rest (1) that approximately 24 ridges (6) of height ¼ to 1 inches, thickness 1/16 to ⅜ inches and spacing of ¼ to 2 inches center to center between ridges (6) works well. Some taper to the sides of the ridges (6) is preferable to facilitate the molding of the foam. However, it has been found that the rectangular shape of FIG. 11 provides the best structural support for the head.

When the integral skin polyurethane foam is forced into the injection mold (7), as the foam cools it forms a soft yet rigid exterior surface (10) against the injection mold ridge surfaces (12). The foam walls (11) forming the body of the wall (4) remains soft and flexible. This combination of rigid exterior surface (10) with support ridges (6) and body of soft foam wall (11) provides structure to support the weight of a person's head and a passageway (5) to receive a person's arm while providing a softness for comfort of resting the head. The ridge (6) construction allows the flexure of the head rest (1) along the longitudinal axis.

Figure 7:
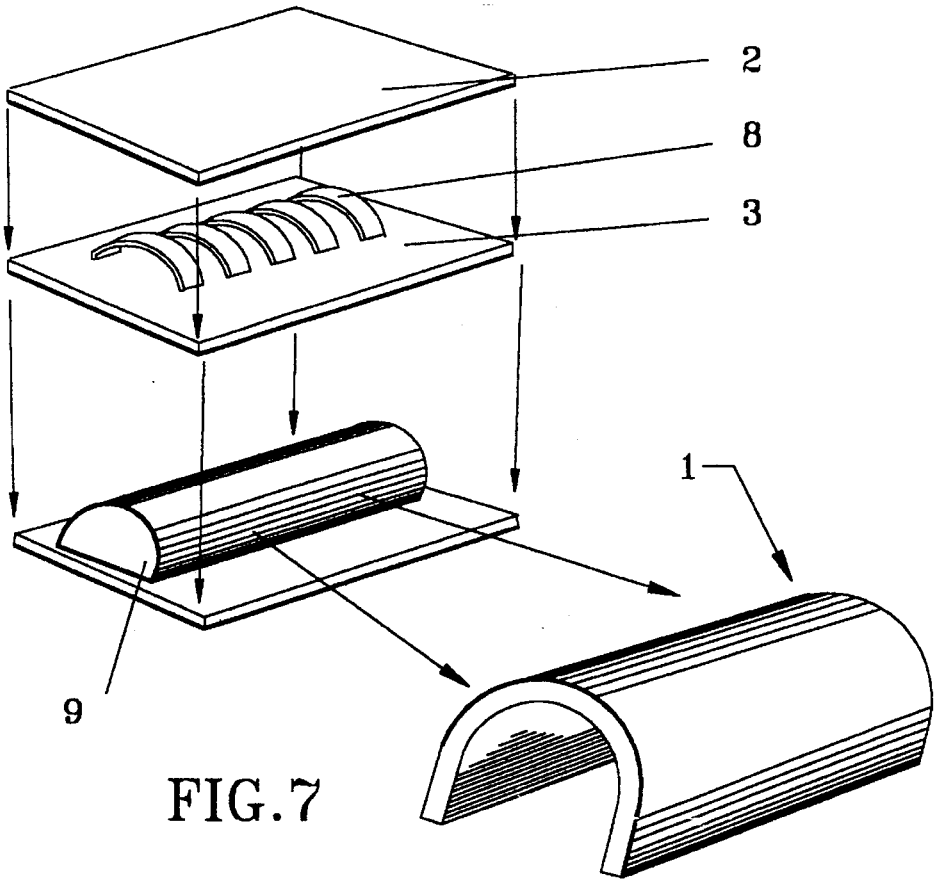
FIG. 7 illustrates a method of fabricating the head rest.
Figure 2:
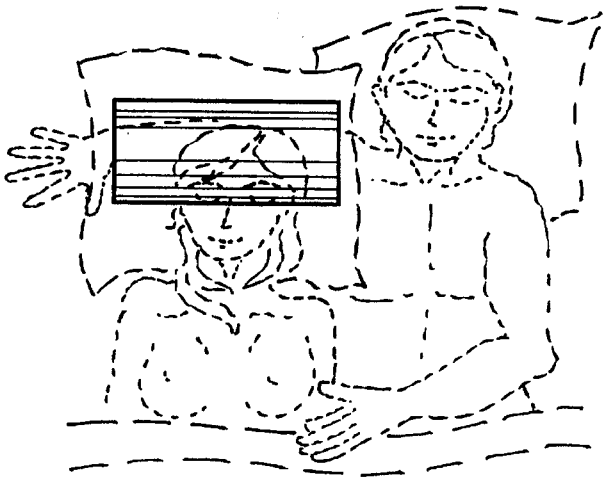
FIG. 2 illustrates the use of the head rest under a pillow being used by a second person.
Figure 3:
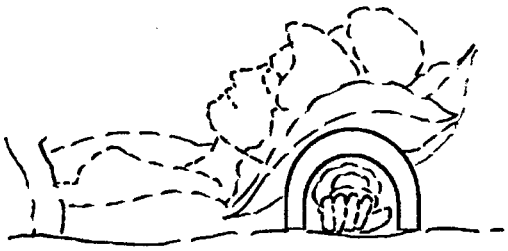
FIG. 3 illustrates a side view of the head rest in use.
Figure 4:
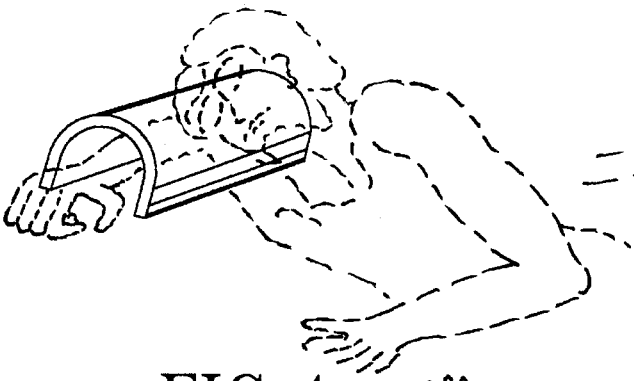
FIG. 4 illustrates the head rest in use with the arm extended through the head rest.
Figure 5:
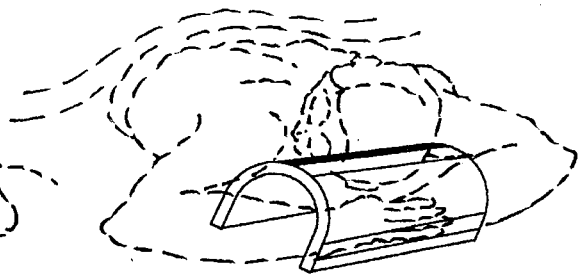
FIG. 5 illustrates the head rest in use with both arms of the person inserted in the head rest.

A second method of constructing the head rest (1) is illustrated in FIG. 7. In this embodiment specific U-shaped plastic or other material reinforcing ribs (8) are used for structural strength. A cylindrical mold (9) is used to form an inner surface (3) and outer surface (2) layer of resilient foam on the ribs (8). A glue or temperature treating process may be used to mold the inner surface (3), outer surface (2) and ribs (8) together. The spacing of the ribs (8) allows this embodiment flexibility along the longitudinal dimension. This embodiment may also be manufactured by placing the U-shaped ribs (8) in an injection mold and forming the foam mold around the ribs (8).

The reinforced head rest has sufficient rigidity such that when a head is resting on the head rest, an arm may be positioned in the passageway beneath the wall in a manner that dose not require the arm to support the weight of the head.

The foam form of the head rest (1) may be covered with a cloth material.

I claim:

1. A device for resting a head comprising a head rest of generally semicircular cross section formed as half an elongated cylinder having an outer surface, an inner surface and a wall of resilient foam reinforced with a plurality of spaced apart U-shaped ribs contained in the wall, whereby the head rest has sufficient rigidity such that when a head is resting on the head rest, an arm may be positioned in a passageway beneath the wall in a manner that does not require the arm to support the weight of the head.

2. The device as in claim 1 wherein the head rest is covered with a cloth cover.

* * * * *